United States Patent [19]

Brun et al.

[11] 4,268,371

[45] May 19, 1981

[54] CABLE GUIDE FOR A TUBULAR ANODE

[75] Inventors: Bernard T. Brun, Dayton; John W. McKinney, Jr., Xenia, both of Ohio

[73] Assignee: The Duriron Company, Inc., Dayton, Ohio

[21] Appl. No.: 129,950

[22] Filed: Mar. 13, 1980

[51] Int. Cl.[3] ..... C23F 13/00

[52] U.S. Cl. ..... 204/196; 204/280

[58] Field of Search ..... 204/147, 148, 196, 197

[56] References Cited

U.S. PATENT DOCUMENTS

| | | | |
|---|---|---|---|
| 1,608,709 | 11/1926 | Mills | 204/197 |
| 2,708,214 | 5/1955 | Galloway | 429/89 |
| 3,071,531 | 1/1963 | Hosford | 204/196 |
| 3,239,443 | 3/1966 | Bryan et al. | 204/196 |
| 3,326,791 | 6/1967 | Heuze | 204/196 |
| 3,340,173 | 9/1967 | Kovalik et al. | 204/196 |
| 3,471,395 | 10/1969 | Sumner | 204/196 |
| 3,623,968 | 11/1971 | Bohne | 204/197 |
| 4,096,051 | 6/1978 | Annis et al. | 204/196 |
| 4,170,532 | 10/1979 | Tatum | 204/196 |

FOREIGN PATENT DOCUMENTS

| | | | |
|---|---|---|---|
| 1153172 | 5/1969 | United Kingdom | 204/196 |

*Primary Examiner*—T. Tung

*Attorney, Agent, or Firm*—Biebel, French & Nauman

[57] ABSTRACT

A cable guide for an impressed current tubular sacrificial anode is a cable conduit sized to enclose and hermetically seal an anode cable and a plurality of spacers removably mounted along the conduit at spaced locations and sized to fit in abutting relationship with the inside wall of an anode body. The cable guide is made from a corrosion resistant fluoropolymer plastic or similar material such as low density polyethylene. The cable guide prevents rebbing, wearing, or other types of abrasive damage that can be sustained by the insulation of the anode cable from the rough end of a partially oxidized tubular anode and protects the cable insulation from corrosive electrolyte solutions.

3 Claims, 3 Drawing Figures

CABLE GUIDE FOR A TUBULAR ANODE

BACKGROUND OF THE INVENTION

1. Field of the Invention

The present invention relates to electrical cable guides, and more particularly to cable guides for protecting and aligning the anode cable of a tubular sacrificial anode.

2. Prior Art

Tubular sacrificial impressed current anodes have recently been developed for use in cathodic protection systems in severe environments such as deep ground beds or sea water service. These tubular anodes are particularly suited for such use because they substantially reduce localized rapid consumption of the anode.

Such an anode is disclosed in U.S. Pat. No. 4,096,051, assigned to the assignee of the present invention. A hollow tubular anode body has an internally mounted anode cable connection which is isolated from the electrolyte solution by a mastic encapsulated by two circular caps. The cable is insulated and extends through an opening in a cap along the central axis of the anode body to a power source located externally of the anode. The anode cable is centrally positioned within the anode body by an epoxy disc mounted in an end of the anode body which has a centrally located hole through which passes the anode cable.

The purpose for the plastic disc is to center the anode cable and prevent it from rubbing against the interior walls of the anode body during use thereby wearing away the insulation of the anode cable and causing a high rate of rapid consumption of the exposed conductor.

A disadvantage of using such a plastic disc as a cable guide is that, as the anode body oxidizes and shortens in length, the plastic disc is no longer constrained by the walls of the anode body and the anode cable is thereby free to rub against the rough shortened end of the anode body. Therefore, a need exists for a device which will keep the anode cable in the center of the anode body and eliminate abrasive friction during all periods of use.

It has also been found that the disc-shaped cable guide of the prior art may be unsuitable in certain instances for use in harsh environments such as ground beds and deep sea locations. The intense hydrostatic pressures of these environments force small amounts of electrolyte past the seam between the epoxy disc and the anode body and into the interior portion of the anode body where it reacts with the anode body to form corrosive gas which attacks the insulation of the anode cable. Therefore, a need also exists for a cable guide that allows escape of gas formed within the anode body and protects the anode cable from a corrosive environment.

SUMMARY OF THE INVENTION

The present invention provides an improved cable guide for use with a sacrificial tubular anode which maintains the anode cable in a central position within the anode body at all times while the anode body is being oxidized and thereby prevents abrasion of the cable by the rough end of a partially oxidizied anode body. In addition, the cable guide of the present invention is inexpensive to manufacture and can be adapted to fit any size tubular anode.

The cable guide of the present invention permits the escape of gases formed within the anode body. At the same time, the cable guide encloses the anode cable and forms a hermetical seal against a potentially corrosive environment.

The cable guide of the present invention comprises a cable conduit sized to enclose and hermetically seal an anode cable and a plurality of spacers removably mounted along the conduit at spaced locations and sized to fit in abutting relationship with an inside wall of a hollow tubular anode body. The use of separate spacers which are removably mounted on the cable conduit tubing allows use of the same size protective conduit for all tubular anode sizes as well as a wide range of cable sizes. To use the cable guide with an anode of a given size, the conduit is merely fitted with spacers of an appropriate diameter.

Accordingly, it is an object of this invention to provide a cable guide for a sacrificial tubular anode which protects and centers the anode cable throughout the useful life of the anode by eliminating the abrasion of the anode cable against the rough end of a partially oxidized anode body; to provide a cable guide that is inexpensive to fabricate and can be made from inexpensive but corrosion resistant materials; to provide a cable guide that can be modified at a small expense to fit any size of tubular anode body; to provide a cable guide that encloses and hermetically seals the anode cable to prevent contact of the cable with a corrosive electrolyte; and to provide an anode cable guide which permits escape of gases formed within the anode body.

Other objects and advantages of the invention will be apparent from the following description, the accompanying drawings and the appended claims.

DETAILED DESCRIPTION OF THE PREFERRED EMBODIMENT

Figure 1:
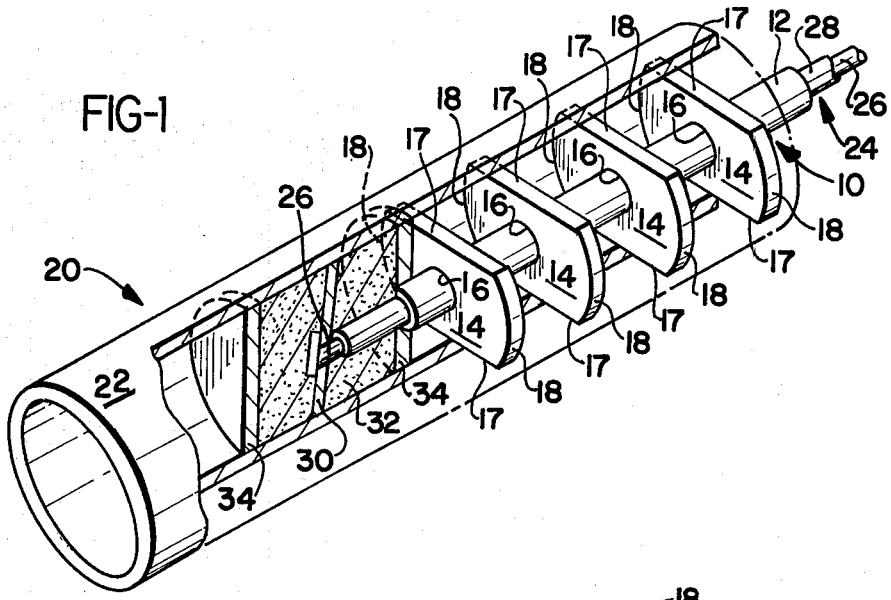
FIG. 1 is a perspective view of a tubular anode cut away to show the cable guide of the present invention.
Figure 2:
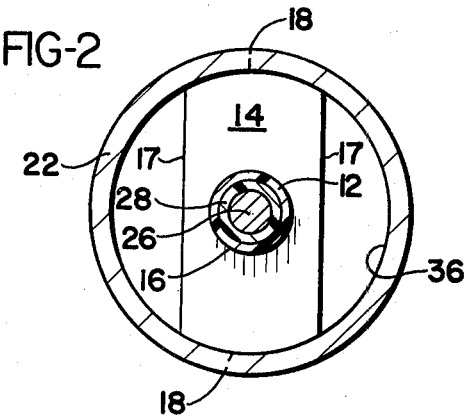
FIG. 2 is an end elevation of the present invention fitted over an anode cable.

As shown in FIGS. 1 and 2, the cable guide of the present invention, generally designated 10, comprises a single cable conduit 12 and a plurality of spacers 14, each having a central hole 16. The spacers 14 are generally rectangular in shape and have a pair of opposing flat edges 17 and a pair of opposing arcuate edges 18. The central hole 16 of the spacer 14 is sized to receive the conduit 12 and provide a snug fit so that a spacer may be positioned on the conduit 12 at a predetermined location along its length and remain there during use.

As best shown in FIG. 1, the cable guide is positioned within a tubular impressed current sacrificial anode, generally designated 20. The anode 20 consists of a hollow tubular anode body 22, an anode cable 24, consisting of a conductor 26 sheathed in an insulator 28, passing through the center of the anode body and terminating at a contact plate 30 embedded in mastic 32 which is held in place by two disc-shaped caps 34. The cable guide fits snugly over the insulated cable 24 and an end of the conduit 12 is embedded in a cap 34 and the opposite end of the conduit 12 extends well beyond the end of the anode body 22. Typically, this distance is 4 inches, but may be longer if the environment requires it.

As shown in FIG. 2, the arcuate edges of a spacer are shaped to abut the interior wall 36 of the anode body 22. If the cable guide 10 is to be used with a larger or smaller anode body 22, the spacers 14 can be slipped off the conduit 12 and replaced with other spacers sized so that their arcuate ends abut the interior walls of the anode body.

Figure 3:
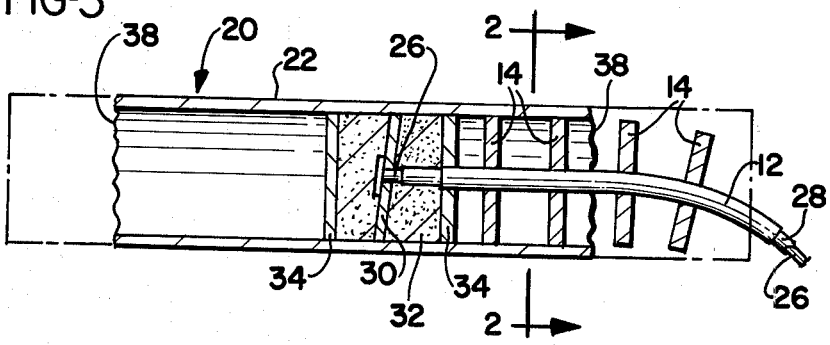
FIG. 3 is a side elevation of a partially oxidized anode body cut away to show the cable guide of the present invention.

The features of the cable guide 10 are best shown in FIG. 3. During operation of the tubular anode 20, the anode body 22 oxidizes thereby gradually decreasing in length. As the anode body 22 decreases in length, it forms a roughened end 38 and movement of the anode cable 24 against the roughened end would cause abrasion of the insulator 28 and exposure of the conductor 26 to a corrosive electrolytic solution. The presence of the spacers 14 maintain the anode cable 24 in a centered position within the anode body 22 at all stages of anode oxidation. In addition, the conduit 12 protects the anode cable insulator 28 from oxidizing and embrittling gases formed during discharge of direct electrical current from the anode 20. These gases are permitted to escape from the interior of the anode body 22 by passing between the space formed between the flat edges 17 and the interior wall 36.

The cable guide 10 can be fabricated from corrosion resistant fluropolymer plastic or similar material such as an inexpensive low density polyethylene. The use of spacers 14 of varying sizes allows use of the same size protective conduit 12 for all tubular anode sizes as well as anode cable sizes to 4/7 AWG wire gage size with 7/64 in. thick HMPE insulation.

While the form of apparatus herein described constitutes a preferred embodiment of this invention, it is to be understood that the invention is not limited to this precise form of apparatus, and that changes may be made therein without departing from the scope of the invention.

What is claimed is:

1. An improved tubular anode of the type having a tubular anode body including an interior wall which defines a hollow cavity, a contact plate packed in a mastic and sealed by caps within a portion of the cavity, and a cable joined to the contact plate, the improvement comprising:

a conduit enclosing and hermetically sealing the cable and having an outside diameter less than the diameter of the cavity; and a plurality of spacers sized to fit in abutting relationship with the interior wall of the anode and shaped to form an open space with the interior wall to permit the escape of gases from the cavity, the spacers removably mounted along the conduit at spaced apart locations such that the conduit cannot be deflected to contact the interior wall.

2. The tubular anode of claim 1 wherein the spacers have a generally rectangular shape and include a pair of opposing arcuate edges and a pair of opposing flat edges, the opposing arcuate edges sized to fit in abutting relationship with an interior wall of the anode.

3. The tubular anode of claim 1 wherein the conduit extends from a point within the mastic to a point beyond an end of the anode body.

* * * * *